US005328431A

United States Patent [19]

Winslow

[11] Patent Number: 5,328,431

[45] Date of Patent: Jul. 12, 1994

[54] EXERCISE BAR

[76] Inventor: Donald E. Winslow, 7846 Pine Trace Dr., Sarasota, Fla. 34243

[21] Appl. No.: 102,266

[22] Filed: Aug. 5, 1993

[51] Int. Cl.[5] ..... A63B 21/075

[52] U.S. Cl. ..... 482/106; 482/93

[58] Field of Search ..... 482/93, 106, 107, 91, 482/148, 49, 91, 108, 50, 907, 139, 109, 74, 135

[56] References Cited

U.S. PATENT DOCUMENTS

| | | | |
|---|---|---|---|
| 1,714,391 | 5/1929 | McWirter | 482/93 |
| 2,528,213 | 10/1950 | Dontolan | 482/93 |
| 3,049,130 | 8/1962 | Fuschetti | 482/91 |
| 3,588,102 | 6/1971 | Gifford | 482/93 |
| 3,820,781 | 6/1974 | Kano | 482/93 |
| 3,942,790 | 3/1976 | Rice | 482/1 |
| 4,440,391 | 4/1984 | Saenz et al. | 482/93 |
| 4,518,162 | 5/1985 | Oats | 482/93 |
| 4,664,373 | 5/1987 | Hait | 482/93 |
| 5,029,847 | 7/1991 | Rose | 482/93 |
| 5,254,063 | 10/1993 | House | 482/106 |

FOREIGN PATENT DOCUMENTS

| | | | |
|---|---|---|---|
| 0456791 | 8/1923 | Fed. Rep. of Germany | 482/106 |

*Primary Examiner*—Stephen R. Crow
*Assistant Examiner*—Jerome W. Donnelly
*Attorney, Agent, or Firm*—Robert J. Bird

[57] ABSTRACT

An exercise bar includes a cylindrical center piece and cylindrical end pieces for selective threaded connection to the center piece. The pieces are of selected weights, chosen from a group of such pieces. Each end piece includes an off center handgrip so that reversing the end pieces relative to the center piece changes the distance between handgrips. Rubber tipped end caps are threaded to the outer ends of the end pieces.

3 Claims, 1 Drawing Sheet

EXERCISE BAR

FIELD OF THE INVENTION

This invention relates to exercise equipment, and more specifically to a multi-purpose exercise bar for lifting and other exercise maneuvers.

BACKGROUND INFORMATION

Aerobic exercise programs typically include the use of some type of dowel or stick to promote extension of various movements, and weights for development of strength and muscle tone. Dumbbells are the weights generally used, but exercise bars of various forms are known in the prior art.

U.S. Pat. Nos. 1,714,391 to McWhirter; 4,440,391 to Saenz et al; and 5,029,847 to Ross show different forms of collapsible exercise bars. They are only generally relevant, but they are the closest prior art that I know of.

SUMMARY OF THE INVENTION

The present invention is an exercise bar, including a cylindrical center piece and cylindrical end pieces for selective threaded connection to the center piece. The pieces are of selected weights, chosen from a group of such pieces. Each end piece includes an off center handgrip so that reversing the end pieces relative to the center piece changes the distance between handgrips. Rubber-tipped end caps are threaded to the outer ends of the end pieces.

DRAWING

DESCRIPTION

Figure 1:
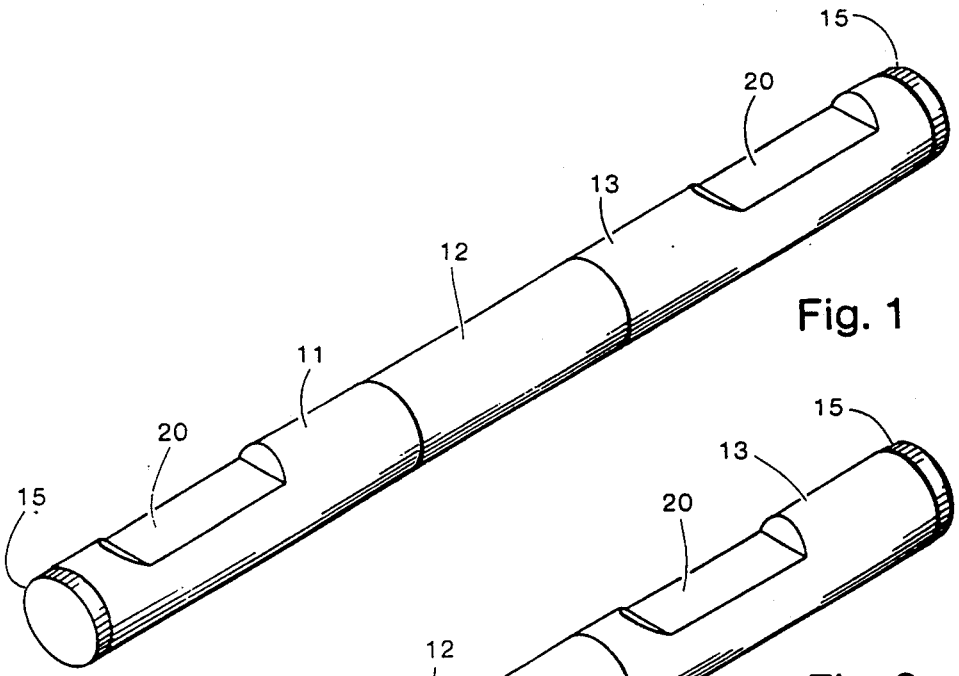
FIG. 1 is three dimensional view of the exercise bar of this invention.

Referring now to the drawing, my exercise bar 10 includes a hollow cylindrical left end piece 11, a similar right end piece 13, and a cylindrical center piece 12. The center piece 12 includes external threads 16 at each end. The end pieces include internal threads 17 and 18 at their ends for selective engagement with the center piece threads 16. Either end of each end piece 11, 13 can thus be the "inner" end, threaded onto the center piece. Removable end caps 15 are threaded into the outer ends of the end pieces 11 and 13.

The bar 10 is 48" long overall and 1" in diameter. The end pieces 11, 13 are 18" long. The center piece 12 is 12" long. The end piece "centers" are about 30" apart.

Figure 2:
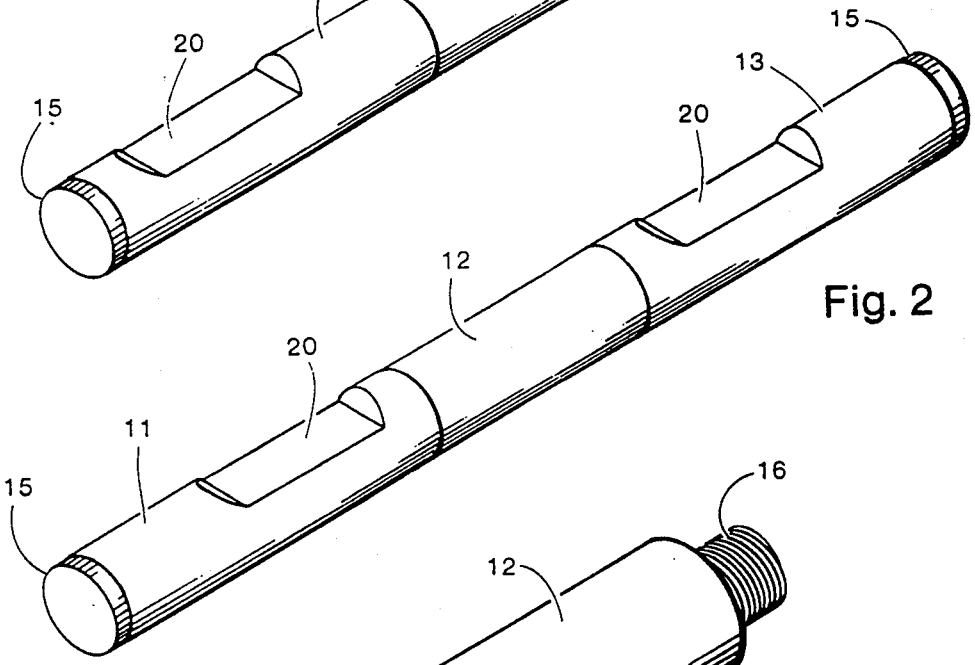
FIG. 2 is a view similar to FIG. 1, with the bar differently assembled.
Figure 3:
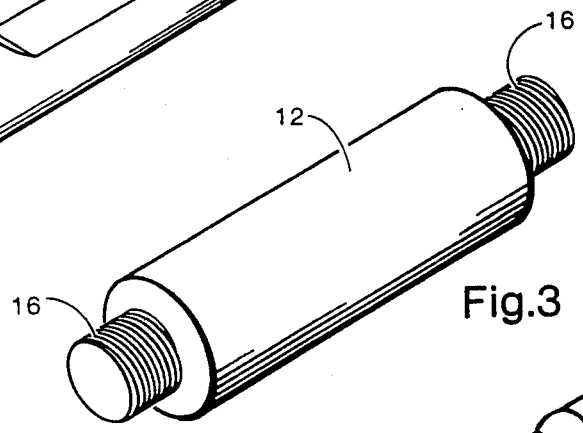
FIG. 3 is an enlarged view of the center piece of my exercise bar.
Figure 4:
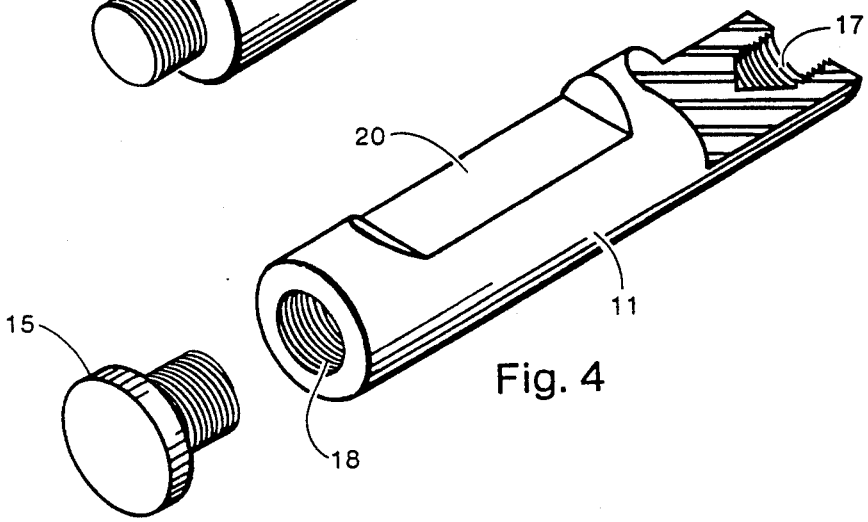
FIG. 4 is an enlarged exploded view of an end piece of my exercise bar.

The end pieces 11 and 13 each include an external flat or recess 20, about 4" along the length of each piece. These are handgrips for the user. The recesses 20 are off center on each end piece by about 2.5". With the end pieces 11, 13 mounted on the center piece 12 as shown in FIG. 1, the recesses 20 are about 35" apart on centers. With the end pieces each reversed and the device assembled as in FIG. 2, the recesses are about 25" apart on centers. This gives the user a choice of grip spread.

There are six pairs of end pieces. The first pair of end pieces 11, 13 are each of a base weight W. The second pair are each of weight W+1 lb. The third pair are each W+2 lbs. The fourth pair are each W+3 lbs. The fifth pair are each W+4 lbs. The sixth pair are each W+5 lbs. Similarly, there are several center pieces 12 of graduated weights M, M+1 lb, M+2 lbs, etc. to M+n−1 lb. (where n is the number of such center pieces). The several pairs of end pieces 11, 13 and the several center pieces 12 are color coded by weight for easy identification in use.

The end pieces 11, 13 and the center pieces 12 are selectively connected to compose an exercise bar 10. In other words, with the different weighted pieces, the exercise bar can be custom assembled as desired through a wide range of total weight.

For aerobic movement, the bar is used with unweighted end pieces 11, 13 of weight W and center piece 12 of weight M. For muscle toning activity, weighted pieces are used, up to a maximum of five additional pounds in the center piece and each end piece.

The end caps 15 are rubber tipped to provide friction for a non-slip use of the bar, as where the bar is used as a support.

The exercise bar is a multi-purpose exercise and fitness device. It is used as a non-weighted bar for aerobic movements and routines. It is used as a weighted bar for specific muscle strengthening and toning activity. Disassembled, the end pieces are used as weighted individual hand weights.

Unlike conventional bar bells which require removal and replacement of end plates and the use of special wrenches or collars, my exercise bar requires only three cylinders which easily screw together.

The foregoing description of a preferred embodiment of this invention, including any dimensions, angles, or proportions, is intended as illustrative. The concept and scope of the invention are limited only by the following claims and equivalents thereof.

What is claimed is:

1. An exercise bar, including:

a cylindrical center piece including threads at the ends thereof;

cylindrical left and right end pieces, said end pieces each including threads at both ends thereof for selective engagement with said center piece;

said end pieces each including an external recessed handgrip located off center on each end piece, whereby reversing said end pieces relative to said center piece changes the distance between said handgrips; and end caps removably threaded to the outer ends of said end pieces.

2. An exercise bar, as defined in claim 1, said end caps being rubber-tipped for non-slip use of said bar.

3. An exercise bar, including:

a cylindrical center piece selected from a number of center pieces of different weights, said center piece including threads at the ends thereof;

cylindrical left and right end pieces selected from a number of pairs of end pieces; said end pieces each including threads at both ends thereof for selective engagement with said center piece;

said end pieces each including an external recessed handgrip located off center on each end piece, whereby reversing said end pieces relative to said center piece changes the distance between said handgrips; and end caps removably threaded to the outer ends of said end pieces.

* * * * *